US005718373A

United States Patent [19]

Kim et al.

[11] Patent Number: 5,718,373

[45] Date of Patent: Feb. 17, 1998

[54] SYSTEM FOR CONTROLLING AUTOMOBILE COOLING FAN

[75] Inventors: Yong-ho Kim, Seoul; Young-sik Lee, Kyonggi-do, both of Rep. of Korea

[73] Assignee: Samsung Electronics Co., Ltd., Suwon, Rep. of Korea

[21] Appl. No.: 635,669

[22] Filed: Apr. 22, 1996

[30] Foreign Application Priority Data

Aug. 11, 1995 [KR] Rep. of Korea ..... 95-24824

[51] Int. Cl.[6] ..... F01P 7/02

[52] U.S. Cl. ..... 236/35; 236/78 D; 165/299

[58] Field of Search ..... 236/34, 35, 46 F, 236/78 D; 165/299

[56] References Cited

U.S. PATENT DOCUMENTS

| | | | |
|---|---|---|---|
| 4,124,001 | 11/1978 | Samuel et al. | 236/35 X |
| 4,425,766 | 1/1984 | Samuel et al. | 236/35 X |
| 4,555,910 | 12/1985 | Sturges | 236/35 X |

*Primary Examiner*—Harry B. Tanner

*Attorney, Agent, or Firm*—Cushman Darby & Cushman IP Group of Pillsbury Madison & Sutro LLP

[57] ABSTRACT

A system for controlling an automobile cooling fan utilizes a temperature-sensitive negative resistance device having a resistance which decreases as the temperature rises, and which increases as the temperature falls. Thus, if the cooling water temperature does not exceed a certain level, the cooling fan motor is not driven. If the temperature exceeds a certain level, the cooling fan motor is driven in proportion with the dynamic temperature variations. Therefore, a variable cooling fan speed is possible, and therefore, the cooling operation becomes efficient.

26 Claims, 4 Drawing Sheets

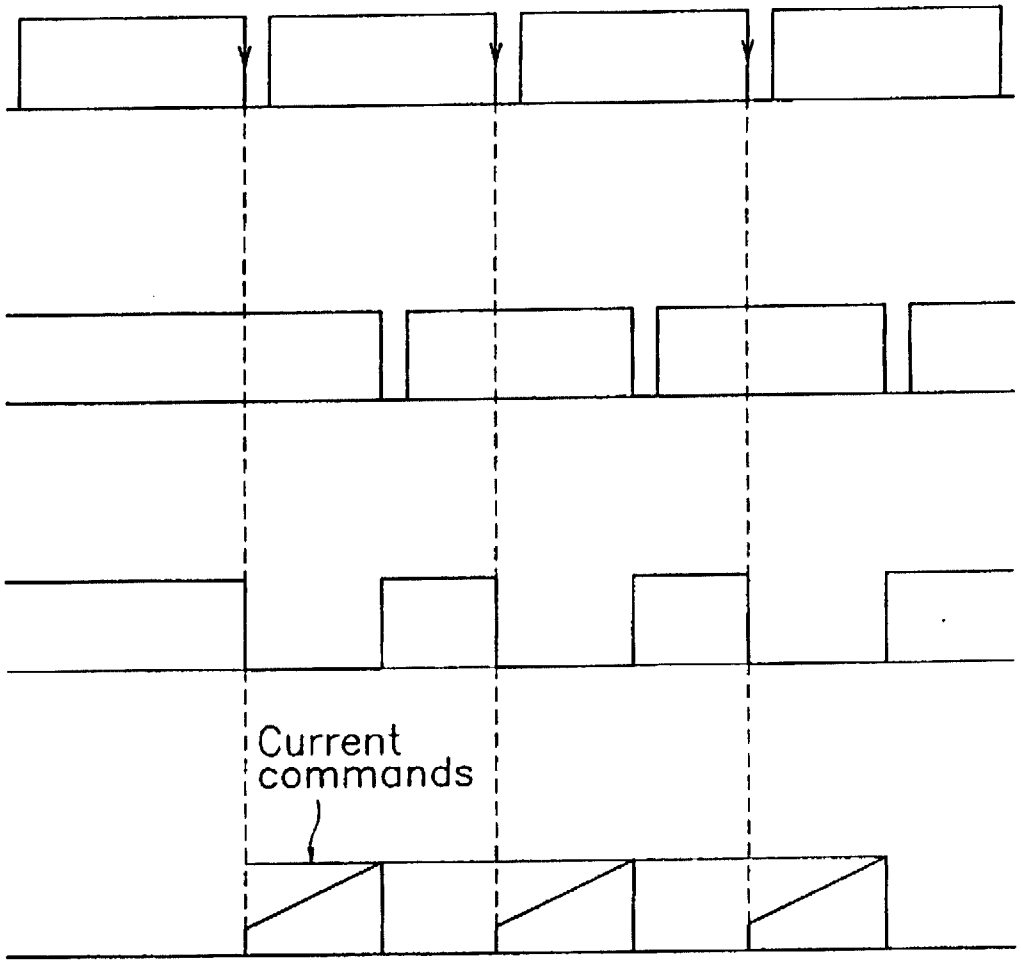
FIG.3A Input clock signals of output logic circuit section
FIG.3B Output signals of pulse width comparing section
FIG.3C Output logic circuit section
FIG.3D Output signals of current detecting section

SYSTEM FOR CONTROLLING AUTOMOBILE COOLING FAN

BACKGROUND OF THE INVENTION (1) Field of the Invention

The present invention relates to a system for controlling an automobile cooling fan. More specifically, the present invention relates to a system for controlling an automobile cooling fan, in which a temperature detecting device having a negative resistance characteristic is utilized so that the revolution speed of the cooling fan can be controlled in accordance with variations of the cooling water temperature.

(2) Description of the Related Art

Most automobiles use a water cooling method to prevent engine over-heating. If the engine overheats, it cannot be returned to the normal temperature merely by circulating the cooling water, because the temperature of the cooling water is also too high. Therefore, a device is required to maintain the cooling water at a normal temperature level, e.g., a cooling fan, is required. Consequently, a system to control the operation of the cooling fan by detecting the cooling water temperature must also be provided.

A conventional technique for controlling an automobile cooling fan will be described below with reference to FIG. 1, which illustrates a conventional automobile cooling fan control circuit.

As shown in FIG. 1, the conventional automobile cooling fan control circuit includes: a cooling fan motor M; a resistor R for limiting the current to the cooling fan motor to thereby control the speed of the cooling fan; and a control switch SW consisting of a first terminal for directly supplying power to the cooling fan motor M, a second terminal with the resistor R connected thereto, and a third terminal which disconnects power from the cooling fan motor M.

The conventional automobile cooling fan control circuit described above operates in the following manner. If the cooling water temperature does not exceed a first set value, the control switch THM SW is positioned at the third terminal, and therefore, the cooling fan motor is not driven. Since the control switch THM SW converts the cooling water temperature into electrical signals to perform switching operations, the control switch is a thermo type switch.

If the cooling water temperature exceeds the first set value, the control switch SW detects the temperature, and shifts the switch to the first terminal. Accordingly, the cooling fan motor M begins a low speed revolution, being limited by the resistor R.

If the engine temperature exceeds a second set value, the control switch SW shifts the switch to the second terminal to drive the cooling fan motor M at a high speed.

In the above described conventional cooling fan control system, however, the revolution speed of the cooling fan motor is controlled using a single resistor, and therefore, the speed control range for the cooling fan motor is very narrow. Accordingly, the temperature of the automobile engine, which varies all the time, cannot be sufficiently controlled, and the cooling fan cannot be operated in an efficient manner, with the result that the life expectancy of the automobile engine is shortened.

SUMMARY OF THE INVENTION

An object of the present invention is to overcome the above described disadvantages of the conventional technique.

It is another object of the present invention to provide a system for efficiently controlling an automobile cooling fan over a wide range of revolution speeds.

It is another object of the present invention to provide a system for maintaining an automobile engine temperature by efficiently controlling the revolution speed of a cooling fan.

In order to achieve these and other objects, the present invention provides a system for controlling an automobile cooling fan which utilizes a temperature-sensitive negative resistance device having a resistance which decreases as the temperature rises, and which increases as the temperature falls. Thus, if the cooling water temperature does not exceed a certain level, the cooling fan motor is not driven. If the temperature exceeds a certain level, the cooling fan motor is driven in proportion with the dynamic temperature variations. Therefore, a variable cooling fan speed is possible, and therefore, the cooling operation becomes efficient.

BRIEF DESCRIPTION OF THE DRAWINGS

The above objects and other advantages of the present invention will become more apparent by describing in detail the preferred embodiment of the present invention with reference to the attached drawings in which:

FIGS. 3A–3D illustrate waveform patterns for the major parts of the system of FIGS. 2A–2C.

DESCRIPTION OF TEE PREFERRED EMBODIMENT

Figure 1:
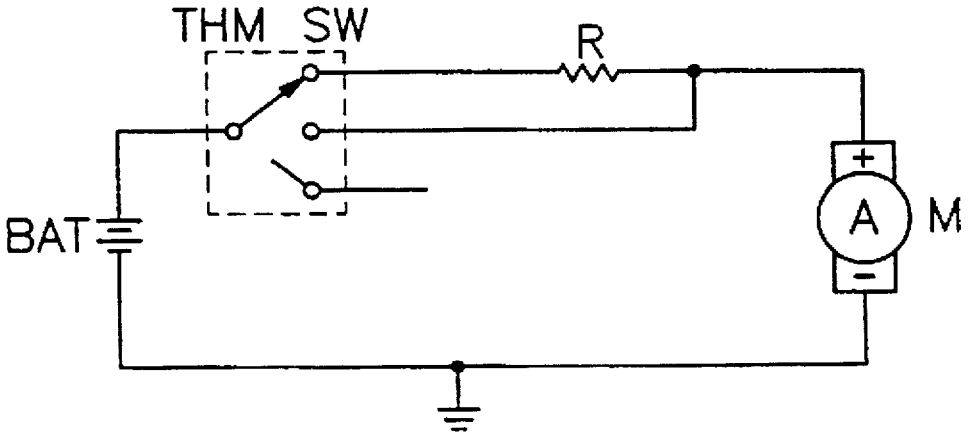
FIG. 1 (PRIOR ART)
FIG. 1 illustrates a conventional automobile cooling fan control circuit.
Figure 2A:
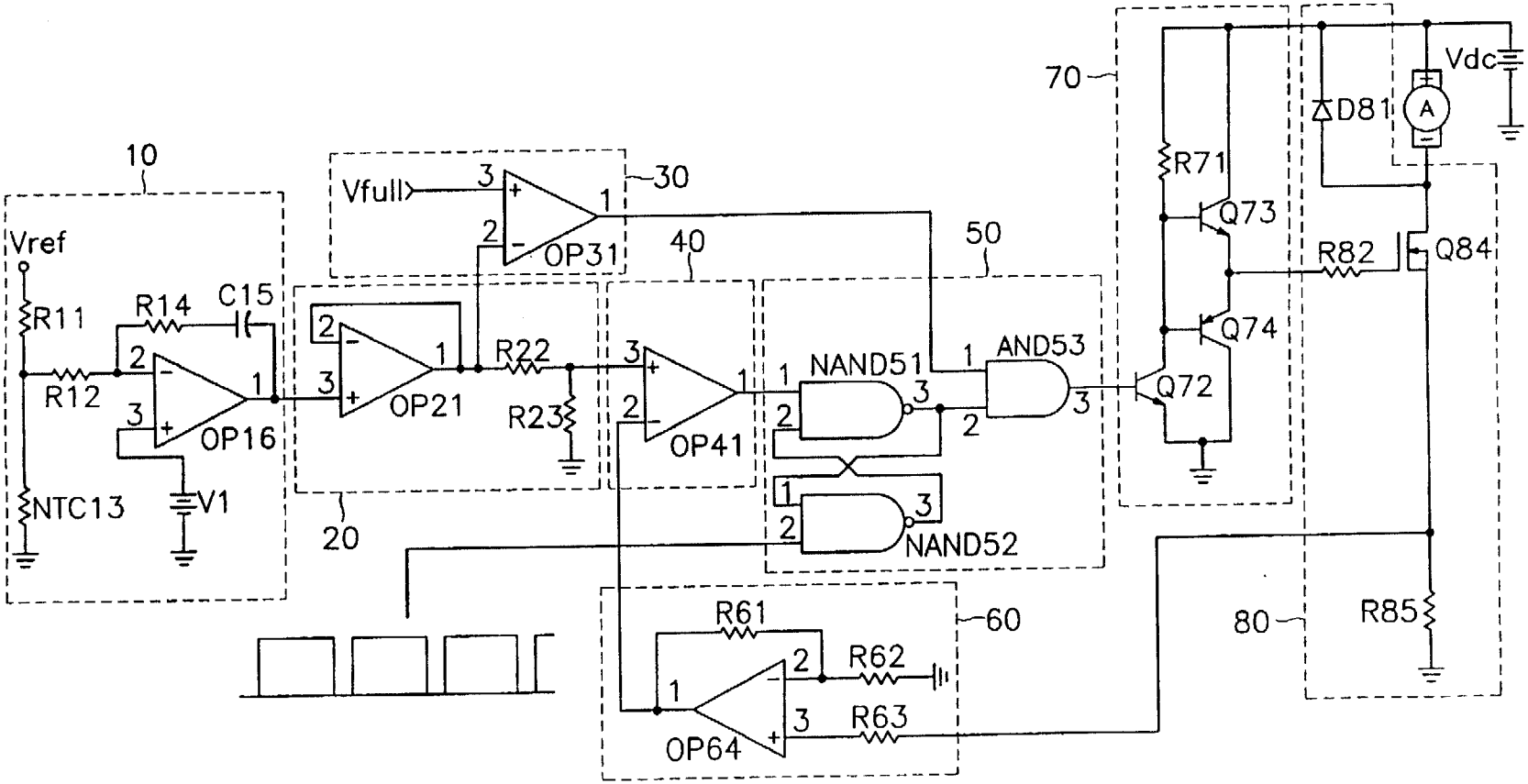
FIGS. 2A–2C illustrate an automobile cooling fan control system according to the present invention.
Figure 2B:
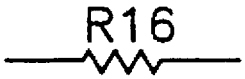
Figure 2C:
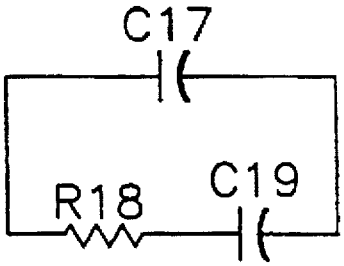

An automobile cooling fan controlling system according to the present invention is shown in FIGS. 2A–2C. In this system, a cooling water temperature detecting section 10 detects a cooling water temperature using a temperature-sensitive negative resistance device, converts the detected temperature into electrical signals, outputs a control command if the temperature of the cooling water exceeds a certain level, and does not output a control command if the temperature of the cooling water is below a certain level.

A current commanding section 20 receives the control signals from the cooling water temperature detecting section 10, and outputs current commands based on the control signals. A current mode deciding section 30 receives the current commands from the current commanding section 20 and augments the current commands so as to drive the cooling fan motor with a maximum voltage if the current command exceeds a certain level. A pulse width comparing section 40 receives the current commands from the current commanding section 20 and current detecting signals from a current detecting section 60, and compares the two sets of signals. An output logic circuit section 50 receives the output signals of the pulse width comparing section, and receives clock signals, and outputs control signals, i.e., signals having a certain duty ratio. An output driving circuit section 70 receives the output signals of the output logic circuit section 50, and converts the received signals into signals suitable for driving the cooling fan motor. A main power circuit section 80 receives the driving control signals of the output driving circuit section 70 so as to directly control the cooling fan motor. The current detecting section 60 detects a current flowing through the motor and amplifies it to a proper controllable voltage, and outputs it to the pulse width comparing section.

The cooling water temperature detecting section 10 further includes: a resistor R11 with one terminal connected to a reference voltage Vref; a negative resistance NTC13 connected between the other terminal of the resistor R11 and ground; a resistor R12 with one of its terminals connected to the other terminal of the resistor R11; a resistor R14 with one terminal connected to the other terminal of the resistor R12; a capacitor C15 with its positive terminal connected to the other terminal of the resistor R14; an OP amplifier OP16 with its non-inverting input terminal connected to the other terminal of the resistor R12, and with its output terminal connected to a negative terminal of the capacitor C15; and a reference voltage V1 connected between the non-inverting input terminal of the OP amplifier OP16 and the ground.

The current commanding section 20 further includes: an OP amplifier OP21 with its non-inverting input terminal connected to an output terminal of the OP amplifier OP16, and with its inverting input terminal and output terminal connected to each other; a resistor R22 with one of its terminals connected to the output terminal of the OP amplifier OP21; and a resistor R23 connected between the other terminal of the resistor R22 and ground.

The current mode deciding section 30 further includes: a comparator OP31 with its non-inverting input terminal connected to a comparing voltage Vfull, and with its inverting input terminal connected to an output terminal of the OP amplifier OP21.

The pulse width comparing section 40 further includes a comparator OP41 with its inverting input terminal connected to the other terminal of the resistor R22.

The output logic circuit section 50 further includes: a NAND gate NAND51 with input terminal 1 connected to an output terminal of the comparator OP41; a NAND gate NAND52 with input terminal 1 connected to the NAND gate NAND51, and with clock pulses connected to input terminal 2, and with its output terminal connected to input terminal 2 of the NAND gate NAND51; and an AND gate AND53 with input terminal 1 connected to an output terminal of the comparator OP31, and with input terminal 2 connected to an output terminal of the NAND gate NAND51.

The output driving circuit section 70 further includes: a transistor Q72 with its base connected to an output terminal of the AND gate AND53, and with its emitter grounded; a resistor R71 connected between a collector of the transistor Q72 and a power source Vdc; a transistor Q74 with its base connected to a collector of the transistor Q72, and with its collector grounded; and a transistor Q73 with its base connected to a collector of the transistor Q72, with its emitter connected to an emitter of the transistor Q74, and with its collector connected to the power source Vdc.

The main power circuit section 80 further includes: a diode D81 with its cathode connected to the power source Vdc; a resistor R82 with one of its terminals connected to an emitter of the transistor Q73; a transistor Q84 with its gate connected to the other terminal of the resistor R82, and with its drain connected to an anode of the diode D81; and a resistor R85 connected between a source of the transistor Q84 and ground.

The current detecting section 60 further includes: a resistor R63 with one terminal connected to a source of the transistor Q84; an OP amplifier OP64 with its non-inverting input terminal connected to the other terminal of the resistor R63, and with its output terminal connected to an inverting terminal of the comparator OP41; a resistor R61 connected between an output terminal of the OP amplifier OP64 and the inverting input terminal of the OP amplifier OP64; and a resistor R62 connected between the inverting input terminal of the OP amplifier OP64 and ground.

The operation of the system of the present invention constituted as above will now be described.

In accordance with the variation of temperature, the negative resistance device NTC13 lowers its resistance value as the temperature rises, and raises its resistance value as the temperature drops. By utilizing such a function, the variation of the cooling water temperature is converted into electrical signals.

Before the cooling water temperature exceeds a pre-set temperature level, if the voltage across the negative resistance device NTC13 is set higher than the comparing voltage V1, the output of the OP amplifier OP16 becomes "0", or a low level. At the same time, the output of the OP amplifier OP21 becomes low, and therefore, the cooling fan motor M does not operate.

As the temperature gradually rises over the pre-set value, the resistance value of the negative resistance device NTC13 gradually decreases, with the result that the voltage across the negative resistance device NTC13 gradually increases.

In this situation, the comparing voltage V1 becomes higher than the voltage across the negative resistance device NTC13, while the resistor R14, the capacitor C15 and the OP amplifier OP16 perform an integrating operation, with the result that a monotone-increasing voltage is outputted.

If the resistor R16 of FIG. 2B is used instead of the resistor R14 and the capacitor C15, then an overshoot can occur in carrying out a proportional operation, and therefore, the operation becomes unstable. As shown in FIG. 2C, if a serial connection of the resistor R18 and the capacitor C19 combined with a parallel connection of the capacitor C19 is used in place of resistor R14 and capacitor C15, then the operation is rendered stable in carrying out a proportional integration.

The signal voltages which are outputted from the OP amplifier OP16 are inputted into the current commanding section 20, with the result that the OP amplifier OP21 outputs a stable signal dc voltage in proportion with the temperature detected by cooling water temperature detection section 10. Further, it is divided into proper voltages controllable by the resistors R22 and R23. As these divided voltages are inputted into the positive input terminal of the comparator OP41, they are compared with the output signals of the current detecting section 60.

The negative input terminal of the comparator OP41 receives signals as described below.

If the power source Vdc is supplied to the motor, the voltage across the motor corresponds to the variation of the electric current versus time, owing to the inductive reactance component of the motor. Therefore, the voltage across the motor increases with a certain gradient. This voltage is detected by the resistor R85, and is inputted through the resistor R63 into the non-inverting input terminal of the OP amplifier OP64.

The voltage across the resistor R85, which is inputted into the non-inverting input terminal of amplifier OP64, is amplified to such a magnitude that it can be suitably compared with the current command inputted into the positive terminal of the pulse width comparing section. The amplified voltage is then inputted into the negative terminal of the comparator OP41 of the pulse width comparing section 40.

The comparator OP41, which receives the above two sets of signals, operates in the following manner. If the current command COM is higher than the output voltage of the current detecting section 60, the comparator OP41 outputs a high level output. On the other hand, if the current command COM is lower than the output voltage of the current detecting section 60, then the comparator OP41 outputs a low level output.

The current command COM is a dc voltage proportional to the current cooling water temperature, while the output voltage of the current detecting section 60 is a monotone-increasing voltage increasing up to a certain level. Initially, the current command COM is higher than the output voltage of the current detecting section 60. Therefore, the output of the comparator OP41 has a high level potential.

Meanwhile, the output voltage of the current detecting section 60 is a monotone-increasing signal voltage in which, as shown in FIG. 3D, the potential of the positive edge portion is low, and the potential of the negative edge portion is high. The point where the voltage of current detecting section 60 reaches the potential of the current command COM is called the comparison point, and the output of the comparator OP41 shifts to a low level at the comparison point. Therefore, the lower the potential of the current command COM (i.e., the lower the cooling water temperature), the sooner the comparison point is reached, and the sooner the comparator output shifts to the low level.

The output signals of the pulse width comparing section 40 as shown in FIG. 3B are inputted into the input terminal 1 of the NAND gate NAND51 of the output logic section 50, while clock signals having a large duty ratio such as that shown in FIG. 3A are inputted into the input terminal 2 of the NAND gate NAND52.

The NAND gates NAND51 and NAND52 are logic-combining circuits performing a function the same as that of RS flip flops. That is, if the input of the input terminal 1 of the NAND gate NAND51 is "1" or a high level, and if the input of the input terminal 2 is "0" or a low level, then the output terminal of the NAND gate NAND51 outputs "0" or a low output. If the input of the input terminal 1 of the NAND gate NAND51 is "0" or a low level, and if the input of the input terminal 2 of the NAND gate NAND52 is "1" or a high level, then the output terminal 3 of the NAND gate NAND51 outputs "1" or a high level output.

Through the above described operations, the output terminal of the NAND gate NAND51 outputs a control signal as shown in FIG. 3C.

This control signal is inputted into the input terminal 2 of the AND gate AND53, while the output signals of the current mode deciding section 36 are inputted into the input terminal 1 of the AND gate AND53. As long as the cooling water temperature has not exceeded a pre-set level, the output of the current mode deciding section 30 is a logic "high" level, so that the output of NAND51 determines the control signal output from output logic section 50.

The current mode deciding section 30 receives the comparison voltage Vfull through its positive input terminal, and receives current commands through its negative input terminal. If the temperature of the cooling water rises continuously, then the output voltage of the cooling water temperature detecting section 10 is continuously increased, and therefore, the voltage of the current command is also increased.

When the voltage of the current command exceeds the comparison voltage Vfull, the comparator OP31 outputs a low potential, and this low potential is inputted into the input terminal 1 of the AND gate AND53. In other words, if the temperature of the cooling water rises above the pre-set level, the current mode deciding section 30 gives an order to drive the motor with the maximum voltage so as to cool down the temperature of the cooling water to the normal level.

The control signals output from the output logic circuit section 50 operate in the following manner. That is, if the control signal is high, a bias potential is supplied to the ends of the base and emitter of the transistor Q72 of the output driving circuit section 70, with the result that the transistor Q72 is turned on, and current of the power source Vdc flows through the transistor Q72 and the resistor R71 to ground.

Since the potential of the base of the transistor Q73 is low, the transistor Q73 is turned off. Meanwhile, the potential of the resistor R71 supplies a bias potential to the ends of the base and emitter of the transistor Q74. Consequently, the potential of the transistor Q74 becomes low, and the potential of the gate of the transistor Q84 becomes low, with the result that the transistor Q84 is turned off, thereby preventing the motor from being driven.

On the other hand, if the control signal is low, the transistor Q72 is turned off, and the potential which is generated on the ends of the collector and emitter of the transistor Q72 supplies a bias potential to the ends of the base and emitter of the transistor Q73, with the result that the transistor Q73 is turned on. Further, the transistor Q74 is turned off, and thus, if the current of the power source Vdc is inputted through the resistor R82 to the gate of the transistor Q84, then the transistor Q84 is turned on, with the result that the motor is activated.

As the cooling water temperature gradually increases, the output of the output logic section has the waveform shown in FIG. 3C, which causes the motor to be alternately activated and deactivated. The revolution speed of the cooling fan is determined by the relative widths of the activating and deactivating pulses. These widths are in turn determined by the pulse width comparing section 40. As a result, the cooling fan revolution speed is proportional to the cooling water temperature.

Meanwhile, when the current command of the current mode deciding section 30 exceeds the comparison voltage Vfull (i.e, when the cooling water temperature exceeds a pre-set level), the comparator outputs a low potential so as to input it into the AND gate AND53. Then the control signal which is generated from the logic combining circuit is disabled, so that the AND gate AND53 outputs a continuously low potential. Then, owing to the operation of the output driving circuit as described above, the motor is driven with the maximum voltage.

According to the present invention as described above, the revolution speed of the cooling fan motor is controlled proportionally with an increase or decrease of the cooling water temperature. In an emergency, the cooling fan motor is driven at the maximum speed, so that the temperature of the cooling water of an automobile is optimized, thereby improving the energy consumption rate. Such features of the present invention can be applied to the cooling water control circuit of automobiles.

Although the present invention has been described above with reference to the preferred embodiments thereof, those skilled in the art will readily appreciate that various modifications and substitutions can be made thereto without departing from the spirit and scope of the invention as set forth in the appended claims.

What is claimed is:

1. A system for controlling an automobile cooling fan motor which rotates a cooling fan at a revolution speed to control a cooling water temperature, comprising:

a current command generator which receives a temperature signal and outputs a current command having a value based on said temperature signal;

a motor detector which detects a current flowing through said cooling fan motor and outputs a current motor signal having a value based on said current flowing through said cooling fan motor for comparison with said current command;

a pulse width comparator which receives and compares said current command and said current motor signal and outputs a pulse width value based on a result of the comparison;

an output logic circuit which receives said pulse width value from said pulse width comparator, and which receives clock signals, and outputs said control pulse signal having a duty ratio based on said pulse width value; and a fan motor controlling circuit which receives said control pulse signal and controls said cooling fan motor so that said revolution speed of said cooling fan is proportional to said cooling water temperature for a predetermined temperature range.

2. A system according to claim 1, further comprising a cooling water temperature detector which outputs said temperature signal in correspondence with said cooling water temperature.

3. A system according to claim 1, wherein said fan motor controlling circuit includes:

an output driving circuit which receives said control pulse signal from said control pulse signal generator and forms driving control signals to drive said cooling fan motor; and a main power circuit which receives said driving control signals and applies power to said cooling fan motor in correspondence with said driving control signals.

4. A system according to claim 1, further comprising:

a current mode deciding circuit which receives said temperature signal and outputs a maximum revolution command when said cooling water temperature exceeds a predetermined value, said fan motor controlling circuit receiving said maximum revolution command and controlling said cooling fan motor to drive said cooling fan at a maximum revolution speed in response thereto.

5. A system according to claim 1, wherein said control pulse generating circuit further includes:

a current mode deciding circuit which receives said temperature signal and outputs a maximum revolution command when said cooling water temperature exceeds a predetermined value, said output logic circuit receiving said maximum revolution command and outputting said control pulse having a constant value so that said cooling fan is driven at a maximum revolution speed in response thereto.

6. The system according to claim 1, wherein said cooling water temperature detector includes:

a negative resistance device connected between a first power supply and a ground potential, said negative resistance device having a resistance value inversely proportional to said cooling water temperature, a voltage across said negative resistance being output to a first node;

an operational amplifier having its inverting input terminal connected to said first node and its non-inverting input terminal connected to a first reference voltage; and a feedback circuit coupled between an output terminal of said operational amplifier and said inverting input terminal.

7. The system according to claim 6, wherein said feedback circuit is comprised of a resistor connected in series with a capacitor.

8. The system according to claim 6, wherein said feedback circuit is comprised of a resistor.

9. The system according to claim 6, wherein said feedback circuit is comprised of a first capacitor connected in parallel with a series connection of a resistor and a second capacitor.

10. The system according to claim 1, wherein said fan motor controlling circuit controls said cooling fan motor so that said cooling fan is not rotated when said cooling water temperature is below said predetermined temperature range.

11. A system for controlling an automobile cooling fan motor which rotates a cooling fan at a revolution speed to control a cooling water temperature, comprising:

a control pulse generating circuit which receives a temperature signal and forms a control pulse signal in accordance with said temperature signal, said control pulse generating circuit including:

a current command generator which receives said temperature signal and outputs a current command having a value based on said temperature signal;

a motor detector which detects an operation of said cooling fan motor and outputs a current motor signal having a value based on an operation of said cooling fan motor for comparison with said current command;

a pulse width comparator which receives and compares said current command and said current motor signal and outputs a pulse width value based on a result of the comparison;

an output logic circuit which receives said pulse width value from said pulse width comparator, and which receives clock signals, and outputs said control pulse signal having a duty ratio based on said pulse width value, said output logic circuit including:

a first NAND gate having a first input terminal connected to an output terminal of said pulse width comparator; and a second NAND gate having a first input terminal connected to an output terminal of said first NAND gate, and having a second input terminal receiving said clock pulses, and having its output terminal connected to a second input terminal of said first NAND gate; and a current mode deciding circuit which receives said temperature signal and outputs a maximum revolution command when said cooling water temperature exceeds a predetermined value, said output logic circuit receiving said maximum revolution command and outputting said control pulse having a constant value so that said cooling fan is driven at a maximum revolution speed in response thereto;

a fan motor controlling circuit which receives said control pulse signal and controls said cooling fan motor so that said revolution speed of said cooling fan is proportional to said cooling water temperature for a predetermined temperature range; and a cooling water temperature detector which outputs said temperature signal in correspondence with said cooling water temperature.

12. A system according to claim 11, wherein said fan motor controlling circuit includes:

an output driving circuit which receives said control pulse signal from said control pulse signal generator and forms driving control signals to drive said cooling fan motor; and a main power circuit which receives said driving control signals and applies power to said cooling fan motor in correspondence with said driving control signals.

13. A system according to claim 11, further comprising:

a current mode deciding circuit which receives said temperature signal and outputs a maximum revolution command when said cooling water temperature exceeds a predetermined value, said fan motor controlling circuit receiving said maximum revolution command and controlling said cooling fan motor to drive said cooling fan at a maximum revolution speed in response thereto.

14. The system according to claim 11, wherein said cooling water temperature detector includes:

a negative resistance device connected between a first power supply and a ground potential, said negative resistance device having a resistance value inversely proportional to said cooling water temperature, a voltage across said negative resistance being output to a first node;

an operational amplifier having its inverting input terminal connected to said first node and its non-inverting input terminal connected to a first reference voltage; and a feedback circuit coupled between an output terminal of said operational amplifier and said inverting input terminal.

15. The system according to claim 14, wherein said feedback circuit is comprised of a resistor connected in series with a capacitor.

16. The system according to claim 14, wherein said feedback circuit is comprised of a resistor.

17. The system according to claim 14, wherein said feedback circuit is comprised of a first capacitor connected in parallel with a series connection of a resistor and a second capacitor.

18. The system according to claim 11, wherein said fan motor controlling circuit controls said cooling fan motor so that said cooling fan is not rotated when said cooling water temperature is below said predetermined temperature range.

19. A system for controlling an automobile cooling fan motor which rotates a cooling fan at a revolution speed to control a cooling water temperature, comprising:

a control pulse generating circuit which receives a temperature signal and forms a control pulse signal in accordance with said temperature signal, said control pulse generating circuit including:

a current command generator which receives said temperature signal and outputs a current command having a value based on said temperature signal;

a motor detector which detects an operation of said cooling fan motor and outputs a current motor signal having a value based on an operation of said cooling fan motor for comparison with said current command;

a pulse width comparator which receives and compares said current command and said current motor signal and outputs a pulse width value based on a result of the comparison; and an output logic circuit which receives said pulse width value from said pulse width comparator, and which receives clock signals, and outputs said control pulse signal having a duty ratio based on said pulse width value;

a fan motor controlling circuit which receives said control pulse signal and controls said cooling fan motor so that said revolution speed of said cooling fan is proportional to said cooling water temperature for a predetermined temperature range, said fan motor controlling circuit including:

an output driving circuit which receives said control pulse signal from said control pulse signal generator and forms driving control signals to drive said cooling fan motor, said output driving circuit including:

a first transistor with its base connected to a control signal terminal of said output logic circuit, and with its emitter grounded;

a first resistor connected between a collector of said first transistor and a power source;

a second transistor with its base connected to a collector of said first transistor, and with its collector grounded; and a third transistor with its base connected to a collector of said first transistor, with its emitter connected to an emitter of said second transistor, and with its collector connected to said power source; and a main power circuit which receives said driving control signals and applies power to said cooling fan motor in correspondence with said driving control signals; and a cooling water temperature detector which outputs said temperature signal in correspondence with said cooling water temperature.

20. A system according to claim 19, wherein said fan motor controlling circuit includes:

an output driving circuit which receives said control pulse signal from said control pulse signal generator and forms driving control signals to drive said cooling fan motor; and a main power circuit which receives said driving control signals and applies power to said cooling fan motor in correspondence with said driving control signals.

21. A system according to claim 19, further comprising:

a current mode deciding circuit which receives said temperature signal and outputs a maximum revolution command when said cooling water temperature exceeds a predetermined value, said fan motor controlling circuit receiving said maximum revolution command and controlling said cooling fan motor to drive said cooling fan at a maximum revolution speed in response thereto.

22. The system according to claim 19, wherein said cooling water temperature detector includes:

a negative resistance device connected between a first power supply and a ground potential, said negative resistance device having a resistance value inversely proportional to said cooling water temperature, a voltage across said negative resistance being output to a first node;

an operational amplifier having its inverting input terminal connected to said first node and its non-inverting input terminal connected to a first reference voltage; and a feedback circuit coupled between an output terminal of said operational amplifier and said inverting input terminal.

23. The system according to claim 22, wherein said feedback circuit is comprised of a resistor connected in series with a capacitor.

24. The system according to claim 22, wherein said feedback circuit is comprised of a resistor.

25. The system according to claim 22, wherein said feedback circuit is comprised of a first capacitor connected in parallel with a series connection of a resistor and a second capacitor.

26. The system according to claim 19, wherein said fan motor controlling circuit controls said cooling fan motor so that said cooling fan is not rotated when said cooling water temperature is below said predetermined temperature range.

* * * * *